US005437142A

United States Patent [19]

Akiyama et al.

[11] Patent Number: 5,437,142

[45] Date of Patent: Aug. 1, 1995

[54] METHOD FOR PACKAGING CONTENTS AND PACKAGING DEVICE

[75] Inventors: Heiemon Akiyama; Minoru Sato, both of Chiba, Japan

[73] Assignee: Toyko Automatic Machinery Works, Ltd., Toyko, Japan

[21] Appl. No.: 128,668

[22] Filed: Sep. 30, 1993

[30] Foreign Application Priority Data

| | | | |
|---|---|---|---|
| Oct. 30, 1992 | [JP] | Japan | 4-293388 |
| Nov. 4, 1992 | [JP] | Japan | 4-295296 |
| Dec. 22, 1992 | [JP] | Japan | 4-342134 |

[51] Int. Cl.[6] ..... B65B 11/22; B65B 51/06

[52] U.S. Cl. ..... 53/415; 53/135.2; 53/230; 53/466

[58] Field of Search ..... 53/135.2, 415, 136.3, 53/136.4, 228, 230, 231, 375.8, 466

[56] References Cited

U.S. PATENT DOCUMENTS

| | | | |
|---|---|---|---|
| 1,864,775 | 6/1932 | Straubel . | |
| 2,226,766 | 12/1940 | Gordon | 53/135.2 |
| 3,063,211 | 11/1962 | Graves | 53/136.3 |
| 3,269,078 | 8/1966 | Ouellette | 53/415 |
| 3,404,507 | 10/1968 | Feigel | 53/415 |
| 3,991,542 | 11/1976 | White et al. . | |
| 4,282,055 | 8/1981 | Bosse | 53/136.3 |
| 4,586,632 | 5/1986 | Kuchler . | |
| 5,159,798 | 11/1992 | Hannon | 53/415 |

FOREIGN PATENT DOCUMENTS

| | | |
|---|---|---|
| 1381075 | 1/1964 | France . |
| 3322867 | 12/1983 | Germany . |
| 3-14685 | 2/1991 | Japan . |
| 3-11124 | 3/1991 | Japan . |
| 3-11125 | 3/1991 | Japan . |
| 390776 | 8/1965 | Switzerland . |
| 2061864 | 5/1981 | United Kingdom . |

*Primary Examiner*—Daniel C. Crane

*Attorney, Agent, or Firm*—Sandler, Greenblum & Bernstein

[57] ABSTRACT

A packaging apparatus for applying a packaging sheet to cover the contents and simultaneously seal them including an adhering mechanism for adhering tape at corresponding sealing positions of the packaging sheet. The adhering mechanism is movable toward or away from the tape feeding-out mechanisms. Adhering tapes are adhered to the corresponding sealing position while being partially projected. The packaging sheet, including the adhering tapes, is fed out by the sheet feeding-out mechanism to the packaging start position. Concurrent to the completion of the folding of the packaging sheet during the packaging operation, projected portions of the adhering tapes are adhered.

20 Claims, 8 Drawing Sheets

METHOD FOR PACKAGING CONTENTS AND PACKAGING DEVICE

BACKGROUND OF THE INVENTION

1. Field of the Invention

This invention relates to a wrapping packaging device in which substantially rectangular-shaped contents, such as piled-up papers, books, longitudinally zig-zag, folded, or overlapped belt-like clothes or fabrics, or accumulated boxes, are covered by a packaging sheet, such as a craft paper. More particularly, the invention relates to a device in which a packaging sheet is supplied by an elevator, the packaging sheet is applied along an outer surface of the contents, the sheet is sealed with an adhesive tape while the packaging sheet and the contents are placed on a mounting surface of the elevator and are transported in a vertical direction from a packaging starting position by the raising or lowering of the elevator.

2. Description of the Background Information

Japanese Patent Publication No. 3-14685 discloses a device including a paper feeding table. A packaging sheet is piled up at the side of the passage used for raising or lowering the elevator, and is directed toward the upper end of the raising or lowering passage and inclined upwardly. Only one packaging sheet, positioned at the downstream end in the accumulating direction, is separated and fed one-by-one from the entire piled-up packaging sheets. The packaging sheet is held in linear line form in relation to the paper feeding table and supplied onto the elevator. The contents are placed at a predetermined position on this packaging sheet, and the elevator is lowered to fold both ends of the packaging sheet into a substantial U-shape. Then both ends overlap along the upper surface of the contents to complete the winding stage. Subsequently, the contents are horizontally transported from the elevator toward the discharging table. Both side flaps of each of the feeding end portions of the packaging sheet are folded inwardly along the side surfaces of the contents. Thereafter, the upper flap of each of the feeding ends is folded down along both side surfaces of the contents, and concurrently, adhering tape, fed out by a tape feeding mechanism, adheres to both overlapped ends of the packaging sheet and is sealed. Thereafter, the lower flap folds along the outside of the folded upper flap, and the extreme ends of the outermost overlapped lower flap, under an inward projecting movement of the guide, are folded along the upper surface of the contents. The adhering tape, fed out by the tape feeding mechanism, adheres to the upper surface of the contents, together with the extreme end of the lower flap, by an adhering mechanism, and is sealed.

In addition, Japanese Utility Model Publication No. 3-11124, discloses a device in which a paper feeding table, where packaging sheets are accumulated at the side of the raising or lowering passage of the elevator, is mounted, inclined by about 45°, toward the upper end of the raising or lowering passage. The feeding-out rollers, acting as the sheet feeding mechanism, are arranged above the packaging sheets accumulated on the paper feeding table, while being held in a linear line state. Only the packaging sheet positioned at the upper end is separated one-by-one under the rotation of the feeding-out rollers, and fed out in a substantial horizontal direction onto the elevator. The elevator is lowered after the contents are placed on the predetermined position on the packaging sheet. Thereby, the packaging sheet is bent along both side surfaces of the contents into a substantial U-shape. Thereafter, both ends of these folded packaging sheets overlap along the upper surface of the contents by a winding mechanism, to complete the winding operation. At the same time, the feeding-out rollers are held by chains, and the like, and normally abut against the packaging sheet at the downstream end in the accumulating direction by the weight of the feeding-out rollers. Thereby, even after the packaging sheet on the sheet feeding table is decreased as the feeding-out operation is carried out, the packaging sheet is continuously fed out without being related to this operation.

However, in the prior art packaging device as described above, since the adhering tape is fed out and adhered to the sealing part corresponding to the position of the packaging sheet upon completion of the winding and folding operations, this prior art device has some problems. Specifically, an exclusive stage for adhering the adhering tape is necessary during the packaging stage of the contents. Concurrently, the tape feeding mechanism and the tape adhering mechanism are arranged at each of the positions corresponding to both of the wrapped ends of the wound packaging sheet, and the position corresponding to the lower flap extreme end of both folded feeding-out ends. The guides to be used for winding or folding operations are disposed at the winding and folding completing positions. They are arranged so as not to interfere with the members. The resulting size of the entire device is not only large, but also has a complicated configuration.

In addition, this device has another problem in that it becomes necessary to arrange separating means, using adhering or frictional power, to make a positive separation of only one packaging sheet, positioned at the downstream end in the accumulating direction, from the entire accumulated packaging sheets.

In addition, the paper feeding table where the packaging sheets are accumulated at an angle, while being held in a linear line state, and the raising or lowering passage of the elevator, are arranged side-by-side in a lateral direction. These arrangements require that the inclined, arranging space for the packaging sheet must be in a lateral direction, separate from the raising or lowering passage of the elevator. Correspondingly, the device is elongated in a lateral direction and large.

In view of the foregoing, it may be possible to include a space for arranging the packaging sheet, that has a small lateral direction, by inclining the paper feeding table at nearly its right angle. However, by doing so, the space for arranging the packaging sheet is not only slightly elongated in a vertical direction, from the raising or lowering passage of the elevator, but the size of the packaging sheet, in its winding direction, is two times longer than the width and height of the contents to be packaged. Accordingly, the space for arranging the packaging sheet is required to be longer, in a linear line direction, than the outer shape of the contents. This results in a problem in that the device is large.

Further, the paper feeding table, where the accumulated packaging sheets are mounted, is moved up and down. Therefore, the packaging sheet positioned at the downstream end is kept at the desired height without any relation to the accumulated amount. Accordingly, the feeding-out length, bending from the extreme end of the packaging sheet to the packaging starting position on the elevator, is nearly constant. In this case, it is necessary to support the paper feeding table, where the packaging sheets are accumulated, in such a manner that it may be raised or lowered, and to cooperatively arrange the raising or lowering driving part. This further illustrates the problems with this device. It must be large, and at the same time, its structure is complicated, thereby increasing the cost and difficulty of applying the packaging sheet.

An object of the present invention is to perform a concurrent sealing of the packaging sheet while the sheet is being covered. Another object of the present invention is to separate only one packaging sheet at the downstream end without utilizing any sucking power or frictional force. Still another object of the present invention is to keep the maximum sheet arranging space within the dead space, while only one packaging sheet at the downstream end is separated without utilizing sucking power or frictional force. A further object of the present invention is to keep the packaging sheet, at the downstream end, at the specified position without relating its position to the accumulated amount, or moving the packaging sheet up and down.

SUMMARY OF THE INVENTION

A tape feeding mechanism for feeding-out the adhering tape toward the packaging sheet is provided before the means for supplying and supporting the packaging sheets. The adhering mechanism for adhering the adhering tape is moved toward and away from the adhering tape that has been fed out. This causes a part of the adhering tape to be projected to the corresponding sealing position of the packaging sheet. The apparatus also includes a sheet feeding mechanism, for supplying the packaging sheet, having the adhering tape adhered thereto, along the feeding passage toward the packaging starting position onto the elevator.

Preferably, the accumulated packaging sheets, positioned below the raising or lowering passage of the elevator, are stored substantially in the horizontal direction along the bottom surface of the frame. The extreme ends of these accumulated packaging sheets are bent upwardly along the side surface of the frame. At the same time, the tape feeding-out mechanism is arranged opposed to the extreme ends of the packaging sheets and positioned at the downstream ends of the bent packaging sheets. The extreme ends of the accumulated, bent packaging sheets move toward the bending direction and the counter-bending direction. The adhering mechanism is reciprocally arranged and is capable of moving toward and away from the fed-out adhering tape.

In addition, preferably, the stopper abutting against the end edge of the packaging sheet is reciprocally arranged toward the extreme ends of the bent packaging sheets. The sensor is arranged near the extreme end of the packaging sheet, bent by the adhering mechanism, and at the same time, the stopper is adjusted and moved in response to the output from the sensor, Further, it is preferable that when the adhering mechanism changes its movement from the bending direction of the packaging sheet toward a counter-bending direction, there is provided a partial bending means for partially bending the extreme end of the bent packaging sheet in the counter-bending direction.

The present invention is constructed such that the corresponding sealing position of the packaging sheet is moved, by the adhering mechanism, toward and away from the adhering tape fed out from the tape feeding-out mechanism. Thereby, the adhering tape partially projects and adheres at the corresponding sealing position. Thereafter, the packaging sheet, adhered with this adhering tape, is fed out by the sheet feeding-out mechanism to the packaging starting position, which allows completion of the folding of the packaging sheet during the packaging process, concurrent with adhering the projected part of the adhering tape.

The adhering mechanism moves the extreme end of the packaging sheet in the bending direction, while the packaging sheets are accumulated, causing the extreme end to abut against, and be supported by, the adhering tape fed out of the tape feeding-out mechanism. Thereby, only the extreme end of the packaging sheet, positioned at the lower end in the accumulating direction, is held. Thereafter, the extreme end of the packaging sheet moves in the counter-bending direction, and away from the tape feeding-out mechanism. A recovering force of the packaging sheet returning toward its counter-bending direction is used, thereby forcibly pulling the entire extreme end of another accumulated packaging sheet away from the extreme end of the downstream end packaging sheet held by the adhering tape.

In addition, the packaging sheet is bent while being accumulated between the raising or lowering passage of the elevator. The bottom and side surfaces of the frame and the lower and side part of the raising or lowering passage become a continuous sheet installing space. The extreme ends of the accumulated packaging sheets are displaced from each other at an acute angle, and close contact of the packaging sheets is prevented during the positional displacement.

Further, a part near the extreme end of the bent packaging sheet is detected by the sensor. If its position does not reach the set position, the stopper is moved, thereby pushing out the extreme end of the packaging sheet to the set position.

Furthermore, concurrent with supplying the extreme end of the packaging sheet from the sheet supporting means at the upstream side of the sheet supplying direction, toward the sheet supplying direction, its sliding surface moves toward the sheet supplying direction and is pulled out. Thereby, the packaging sheet is not loose in the downward direction, while being supported on the sliding surface and applied to the downstream side sheet supporting means.

DETAILED DESCRIPTION OF THE PREFERRED EMBODIMENT

Figure 1:
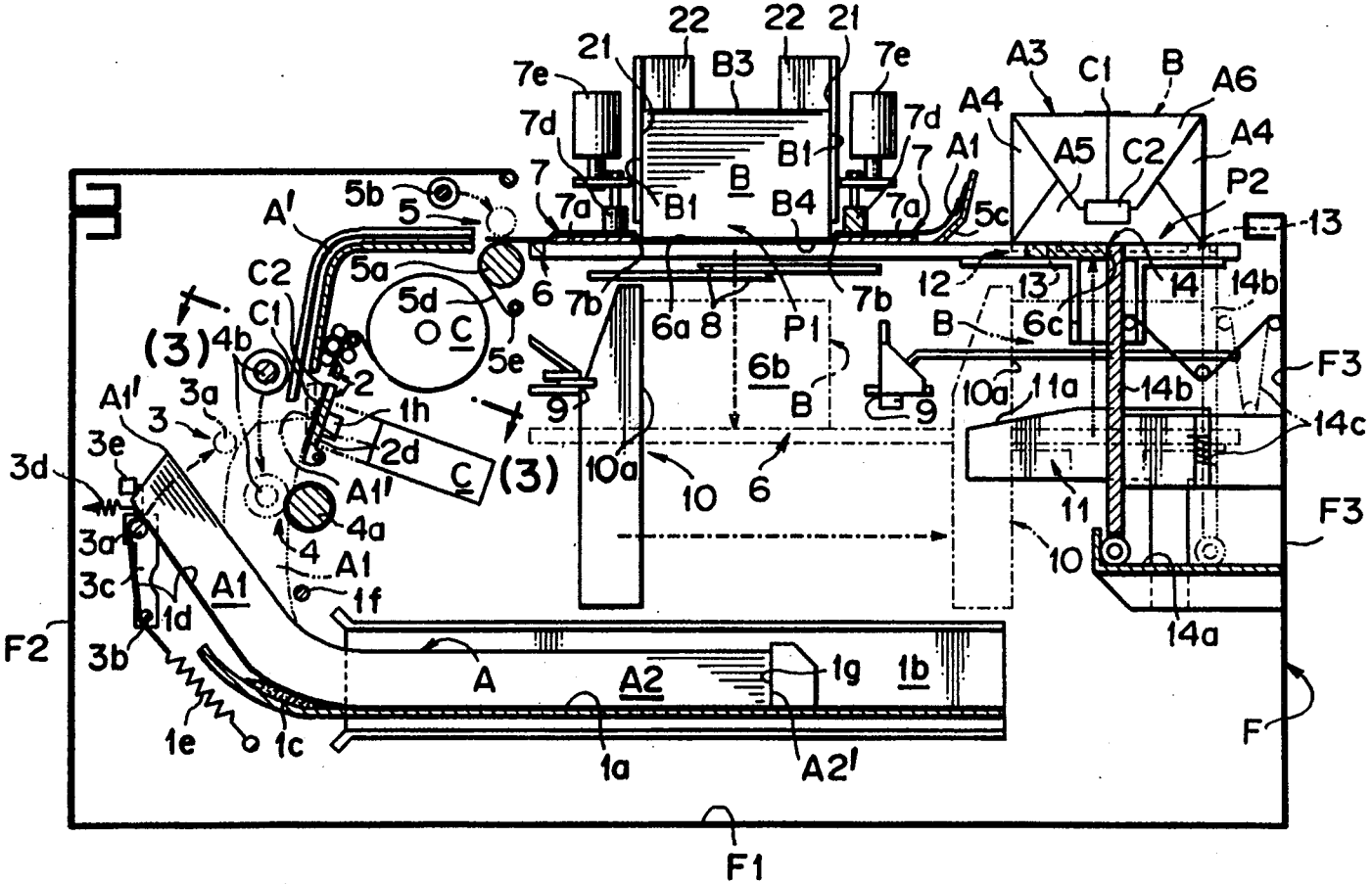
FIG. 1 is a longitudinal front elevational view, in section, showing one preferred embodiment of the packaging device including the packaging starting time and the packaging completion time.

Referring now to the drawings, one preferred embodiment of the present invention will be described as follows.

Figure 2:
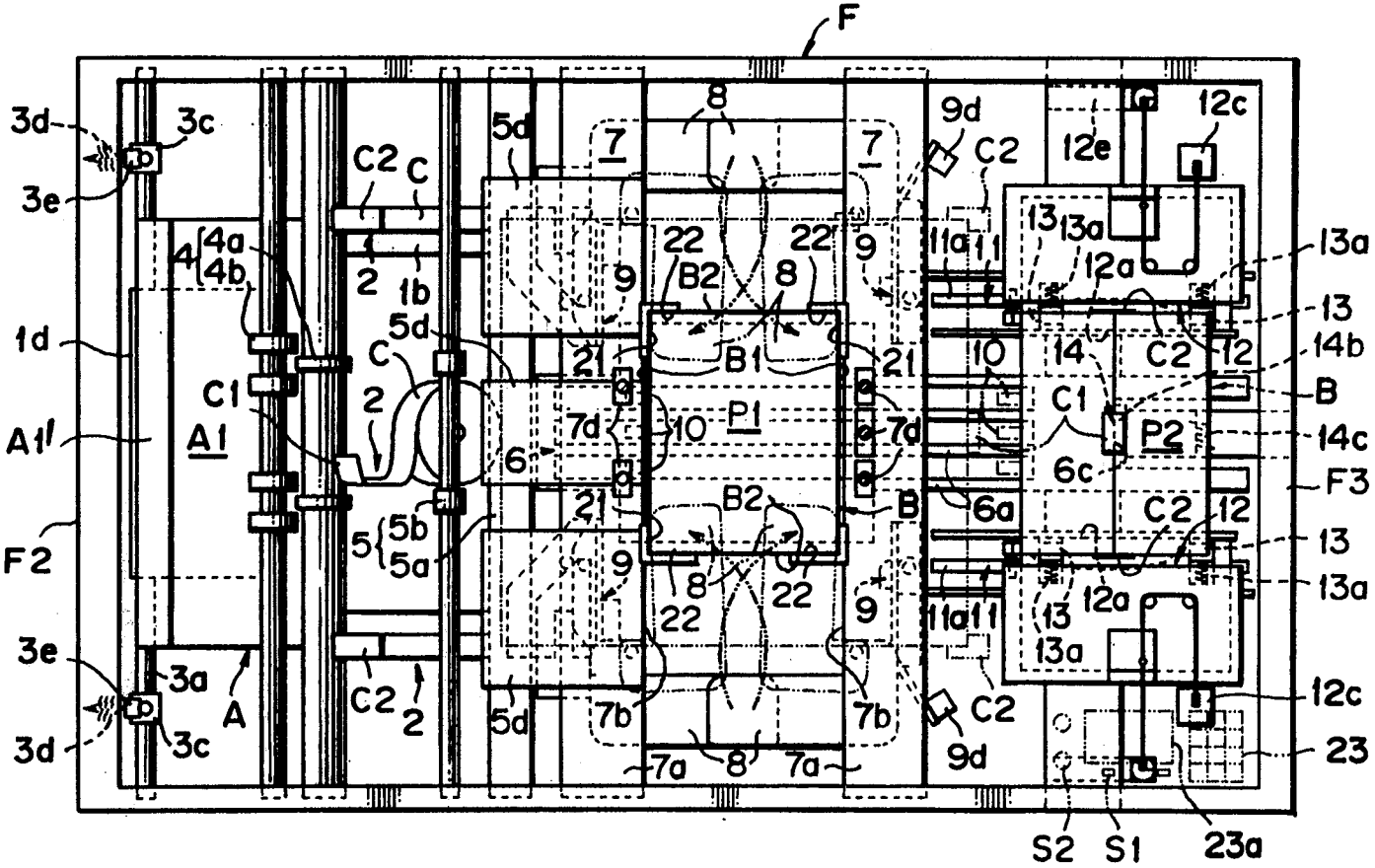
FIG. 2 is a cross sectional top plan view of the packaging device.

As shown in FIGS. 1 and 2, the preferred embodiment is constructed such that the packaging sheets A are piled up in a vertical direction and in a substantially horizontal direction on the paper feeding table 1, which can be raised or lowered in such a manner that the longitudinal direction of the packaging sheets A coincide with a long width direction of the frame F. The extreme ends A1, corresponding to one longitudinal direction of each of these packaging sheets A, are bent in a slant upward direction. The bending operation for bending the extreme ends A1 with the adhering mechanism 3, and the recovering operation for recovering them in the counter-bending direction are repeated. Each of the corresponding sealing positions are arranged at the central right and left directions. Both ends of the right and left directions of extreme end A1' of packaging sheet A, which is positioned at the downstream end in the accumulating direction are adhered to adhering tapes C1, C2, C2, which are supported at tape feeding-out mechanisms 2, 2, 2. Thereby, only packaging sheet A is held at the downstream end. At the same time, packaging sheet A, having adhering tapes C1, C2, C2 adhered thereto, is fed out one-by-one by sheet feeding-out mechanism 4, through inverse L-shaped feeding-out passage A', onto elevator 6.

The paper feeding table 1 is arranged along the bottom surface F1 of the frame F below raising or lowering passage 6*b* of elevator 6. A substantially horizontal mounting surface 1*a* is laterally arranged at the central position of the right and left direction crossing at a right angle with the long width direction of the frame F. The substantially horizontal mounting surface may be reciprocated in a vertical direction. The length of its right and left direction is formed shorter than the short side of the minimum size packaging sheet A. The side guides 1*b*, 1*b*, having U-shaped side surfaces, are oppositely, laterally arranged at the right and left sides of the mounting surface 1*a*. Therefore, the guides need not be moved in a vertical direction, and packaging sheets A are mounted and supported from mounting surface 1*a* over side guides 1*b*, 1*b*.

The part of mounting surface 1*a* that is opposed against the bottom surface of the bent part of each of packaging sheet A, bent upwardly along side surface F2 of frame F, is bent in a slant upward direction. A resilient projection 1*c*, such as a sponge, projects at the central position of the right and left direction of the bent part of each of packaging sheets A, and forcibly contacts the bottom surface of the bent part of each of packaging sheets A. At the same time, a flexible pressing sheet 1*d*, formed by material such as fluorine resin, may be slid upwardly from resilient projection 1*c*, which is fixed on mounting surface 1*a*. The pressing sheet 1*d* is wound around a raising lever 3*a* of the adhering mechanism 3. It is pulled by resilient member 1*e*, such as a spring, and mounted in a tensile form, from the bottom surface of the bent part of each of sheets A along the bottom surfaces of extreme ends A1.

Accordingly, the right and left central position of the bent part of each of bent packaging sheet A bulges out upwardly from resilient projection 1*c*, and bends in a bow-like form. At the same time, mounting surface 1*a* is higher than the lower end of the inner surface of each of side guides 1*b*, 1*b*. Thereby, the substantially horizontal ends A2, bent in a bow-like form, bulge out upwardly. The extreme ends A1 are prevented from being buckled and released downwardly without being related to the accumulated amount of packaging sheets A by these bent parts and the tensile pressing sheet 1*d*. An abutting guide 1*f* is arranged and fixed to the position opposing against the outer surface of the bent part of each of packaging sheets A. The extreme ends A1 of the packaging sheets A are further bent by the adhering mechanism 3, and the upper surface of the bent part of each of the packaging sheets A is bent when pressed against the abutting guide 1*f*.

In addition, side guides 1*b*, 1*b* are supported in such a way that they may be adjusted and moved in a rightward and leftward direction. The tape feeding-out mechanisms 2, 2, are arranged at both the right and left ends of the extreme end A1' of the packaging sheet A, and are cooperatively arranged above the side guides. An adjusting driving part, such as a pulse cylinder, is cooperatively arranged so that the mechanisms are adjusted and moved the same length in the rightward and leftward direction. This movement corresponds to the size variation in a short direction of packaging sheet A. The stopper 1*g* is vertically arranged at end edge A2' of each of the mounted packaging sheets A. The stopper can be adjusted and moved in a length direction of frame F. The adjusting and driving part, such as a pulse cylinder, is cooperatively arranged and controlled in its operation by the control part. The stopper 1*g* moves horizontally in response to the output of sensor 1*h*.

The sensor 1*h* is arranged near extreme ends A1' of bent packaging sheets A1. More particularly, sensor 1*h* is arranged near oscillating supporting surface 2*d* of tape feeding-out mechanism 2, arranged at the central part. When the extreme ends A1' of packaging sheets A pass through the adjusting and driving part of stopper 1*g*, and further bend to abut against adhering tapes C1, C2, C2, the sensor detects the position of extreme end A1' of packaging sheet A. When the extreme end does not reach the setting position, the adjusting and driving part of stopper 1*g* operates until the extreme ends A1 of the next packaging sheets A are further bent by moving extreme ends A2' horizontally toward extreme ends A1.

The tape feeding-out mechanisms 2, 2, 2 include feeding-out rollers 2*a*, 2*a*, 2*a*, abutting against the adhering surfaces of rewound adhering tapes C1, C2, C2, and supporting surfaces 2*b*, 2*b*, 2*b* opposing against each of the non-adhered surfaces of adhering tapes C1, C2, C2. Each of feeding-out passages A1 are arranged downstream of the tape feeding-out direction of the rotatably supported adhering tape rolls C, C, C. Cutters 2*c*, 2*c*, 2*c* cross supporting surfaces 2*b*, 2*b*, 2*b*, which are arranged to project out at the downstream ends from feeding-out rollers 2*a*, 2*a*, 2*a*.

Figure 3:
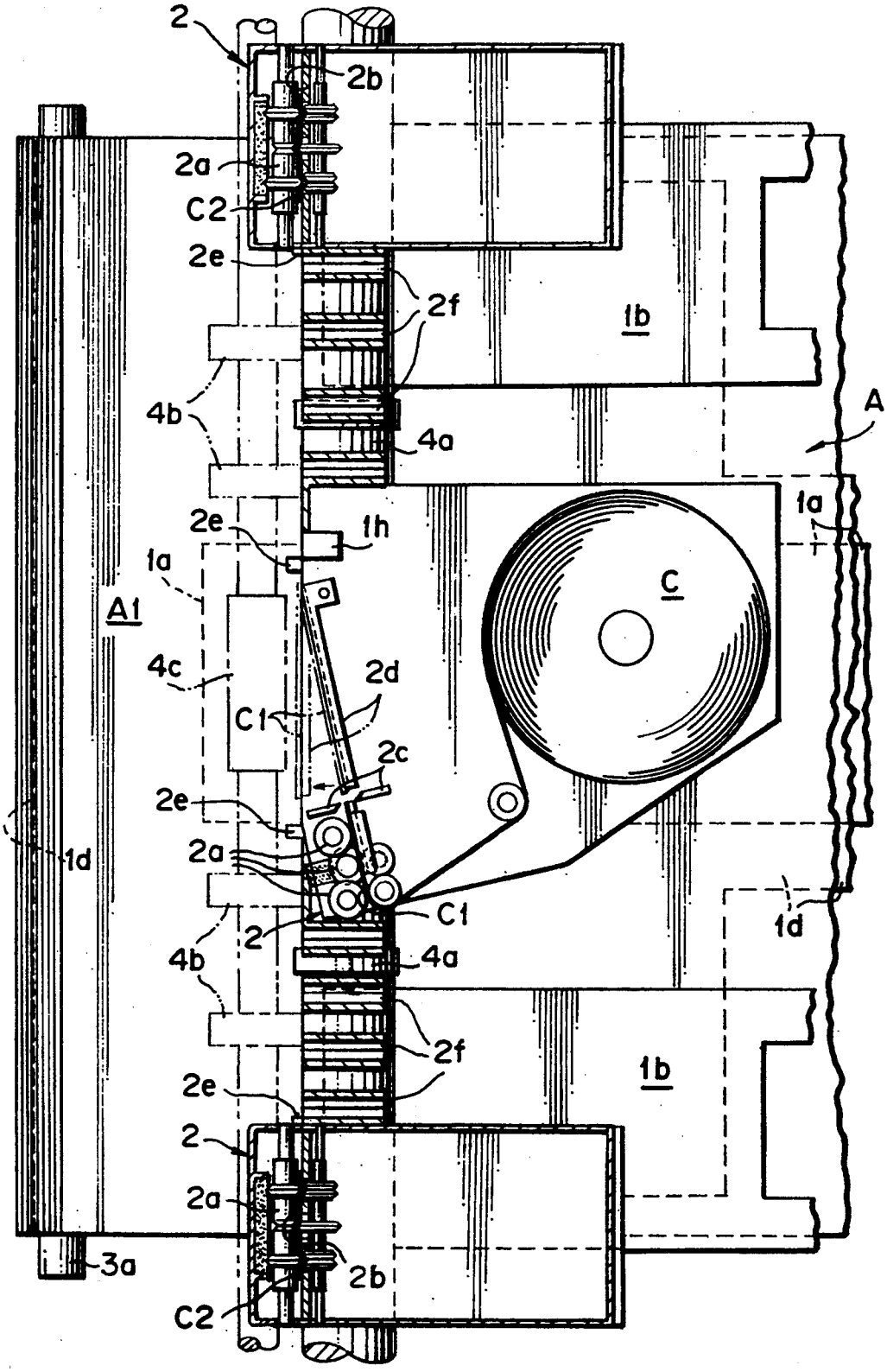
FIG. 3 is a partial enlarged sectional top plan view taken along line (3)—(3) of FIG. 1.
Figure 4A:
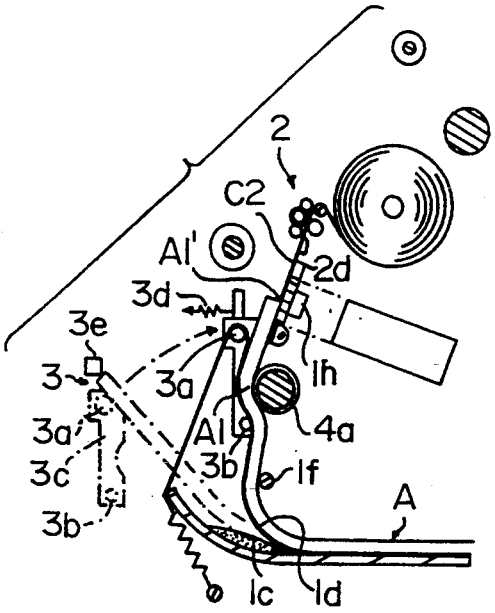
FIGS. 4(*a*)–4(*d*) are partial longitudinal front elevational views in section showing in sequence the feeding-out stages of the packaging sheet.
Figure 4B:
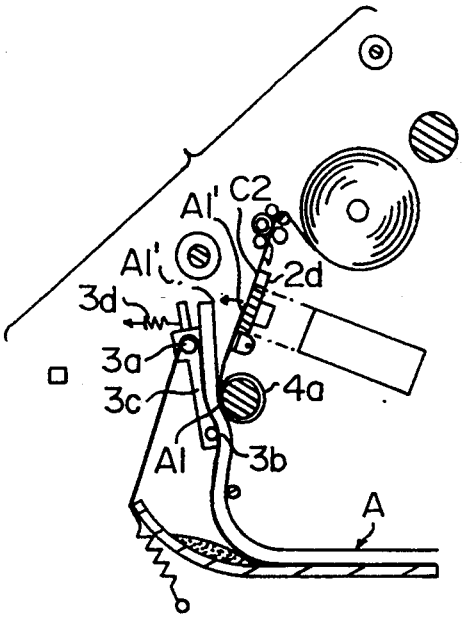
Figure 4C:
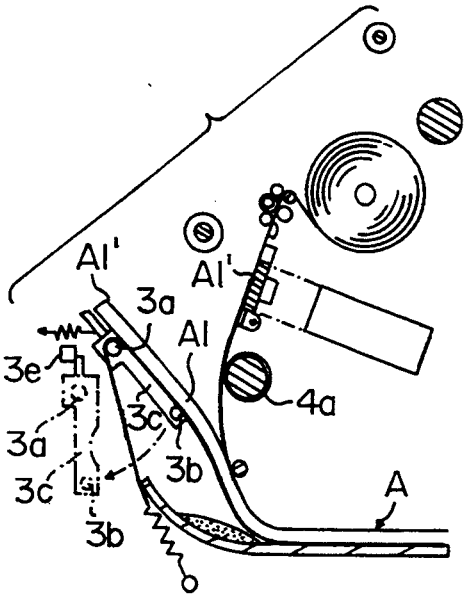
Figure 4D:
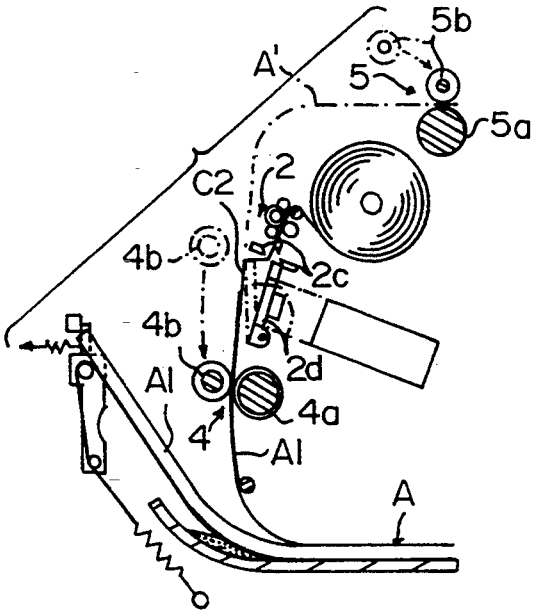
Figure 5A:
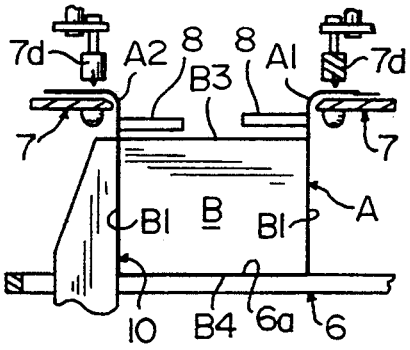
FIGS. 5(*a*)–5(*g*) are partial longitudinal front elevational views in section showing in sequence the winding stages.
Figure 5B:
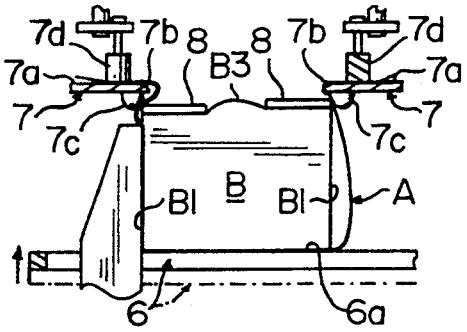
Figure 5C:
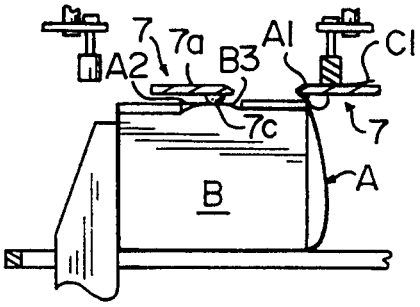
Figure 5D:
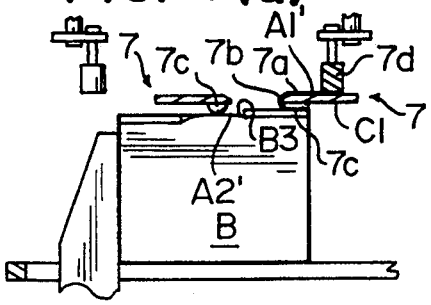
Figure 5E:
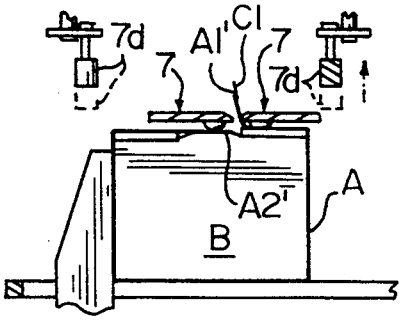
Figure 5F:
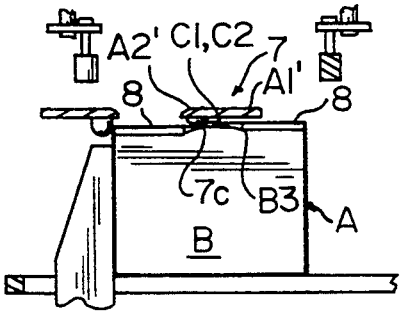
Figure 5G:
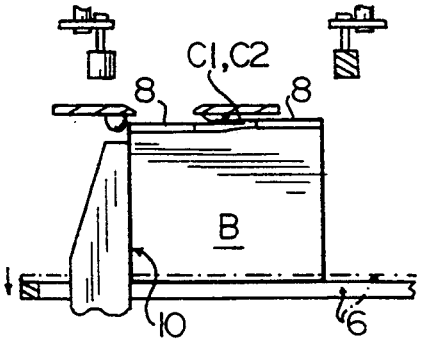

In the preferred embodiment of the present invention, tape feeding-out mechanism 2, arranged opposite the corresponding sealing position arranged at the central part in the right and left direction on extreme end A1' of the packaging sheet A, feeds out adhering tape Cl from adhering tape roll C along supporting surface 2*b*, in the right and left horizontal direction, as shown in FIG. 3. The tape feeding-out mechanisms 2, 2, positioned at both ends of the corresponding sealing positions in the right and left direction of extreme ends A1', feed out adhering tapes C2, C2 from adhering tape rolls C, C along the supporting surfaces 2b, 2b in a vertical direction.

The oscillating and supporting surfaces 2b, 2b are cooperatively arranged in such a way that they may project out toward feeding-out passage A1 at the downstream ends of supporting surfaces 2b, 2b, 2b. The projections 2e, 2e, 2e, for preventing double-sheet adhering, project toward feeding-out passage A1 at each of the oscillating and supporting surfaces 2d, 2d, 2d. Each of the feeding-out rollers 2a, 2a, 2a, cutters 2c, 2c, 2c and oscillating and supporting surfaces 2d, 2d, 2d are cooperatively related with the driving part, such as a stepping motor.

The driving part for tape feeding-out mechanisms 2, 2, 2 is controlled in its operation by the control part in the same manner as that of the adjusting driving part for stopper 1g. The oscillating supporting surfaces 2d, 2d, 2d are initially spaced apart from the feeding-out passage of packaging sheet A, before the feeding-out of packaging sheet A, and delayed there. The feeding-out rollers 2a, 2a, 2a are rotated, after manual operation of sheet feeding-out starting switch S1 or packaging starting switch S2. A predetermined length of each of adhering tapes C1, C2, C2 is fed out from adhering tape rolls C, C, C to oscillating supporting surfaces 2d, 2d, 2d while applying the folding lines extending toward a tape feeding-out direction.

After adhering mechanism 3 moves toward oscillating supporting surfaces 2d, 2d, 2d, only cutter 2c, for tape feeding-out mechanism 2 opposite the central feeding corresponding position, projects out. The oscillating supporting surface 2d instantaneously projects toward feeding-out passage A', just after adhering tape C1 is cut, and returns to its initial state, just after pressing roller 4b of sheet feeding-out mechanism 4 moves near oscillating supporting surfaces 2d, 2d, 2d. The cutters 2c, 2c of tape feeding-out mechanisms 2, 2, positioned at both the corresponding right and left sealing positions, are projected. Just after cutting adhering tapes C2, C2, the oscillating supporting surfaces 2d, 2d, project for a predetermined time, toward feeding-out passage A' of packaging sheet A, and return to their initial state. The feeding-out rollers 2a, 2a, 2a are slightly rotated in reverse, as required, after cutting of adhering tapes C1, C2, C2.

Extension or retraction guides 2f, 2f, formed by bending the resilient material, such as a spring steel plate, in a zig-zag form, are placed between tape feeding-out mechanisms 2, 2, 2. Thereby, tape feeding-out mechanisms 2, 2, positioned at both the corresponding right and left sealing positions, can be adjusted in the right and left direction in response to the size variation of packaging sheets A. This prevents extreme ends A1' of packaging sheet A, positioned at the downstream end in the accumulating direction, from advancing between tape feeding-out mechanisms 2, 2, 2.

The adhering mechanism 3 causes the substantially horizontal raising lever 3a, against the oscillating supporting surfaces 2d, 2d, 2d of tape feeding out mechanisms 2, 2, 2, to be reciprocally supported in a direction moved toward and away the upwardly bent, accumulated extreme ends A1 of packaging sheet A. At the same time, lever 3a abuts against the bottom surfaces of extreme ends A1 of packaging sheets A. The sliding surface 1f, fixes the resilient member, such as a sponge, to the outer surface of raising lever 3a. Therefore, even if the accumulating amount of packaging sheets A is reduced, they may still be positively pushed against oscillating supporting surfaces 2d, 2d, 2d.

The raising lever 3a is cooperatively related to the driving part, such as a stepping motor, to cause raising lever 3a to be reciprocated by the driving part. At the same time, horizontal wedge lever 3b is oscillatably and laterally arranged at the position opposed to the lower part of feeding-out roller 4a, so as to construct a partial bending means. These oscillating pieces 3c, 3c are cooperatively provided with resilient members 3d, 3d such as springs. The wedge lever 3b is always pressed in a direction approaching the lower part of feeding-out roller 4a. The fixed stoppers 3e, 3e, abutted against oscillating pieces 3c, 3c, are arranged midway from where rising lever 3a and move away from oscillating supporting surfaces 2d, 2d, 2d of tape feeding-out mechanisms 2, 2, 2. The wedge lever 3b oscillates in a direction moving away from the lower part of feeding-out roller 4a.

The driving part for adhering mechanism 3 is controlled by the control part. The raising lever 3a moves toward the direction that extreme ends A1 of the packaging sheets A are returned to before the feeding-out of the packaging sheet A. A packaging sheet A, positioned at the downstream end in the accumulating direction, is moved away from abutting guide If. The oscillating supporting surface 2d, of each of feeding-out mechanisms 2, raising lever 3a and wedge lever 3b, are moved in a direction in which the extreme ends A1 are bent. This occurs after adhering tapes C1, C2, fed out by each of feeding-out rollers 2a, and extreme end A1' of downstream end packaging sheet A, press against oscillating supporting surface 2d of each of the tape feeding-out mechanisms 2. Thereafter, raising lever 3a is delayed slower than the opposite direction of the initial movement. For example, the lever is moved at one-third the initial speed, away from oscillating supporting surfaces 2d, 2d, 2d, and returns to its initial state.

The sheet feeding-out mechanism 4 comprises feeding-out roller 4a, arranged to be lower than oscillating supporting surface 2d of each of tape feeding-out mechanisms 2, and pressing roller 4b arranged to be reciprocally moved in a direction toward and away from feeding-out roller 4a below feeding-out passage A'. The packaging sheet A is held between feeding-out roller 4a and pressing roller 4b, and bent, in a corrugated form, in a direction crossing at a right angle with feeding-out passage A'. Thereby, the advancing movement toward the feeding-out direction is increased, enabling the upward transportation of packaging sheet A to be carried out.

The position, opposite tape adhering mechanism 2, and arranged to correspond to the central part of pressing roller 4b, is covered by non-adhering material 4c, such as silicone rubber, to prevent adherence of adhering tape C1. The feeding-out roller 4a, and pressing roller 4b are cooperatively related with the driving part, such as a stepping motor. The feeding-out roller 4a is intermittently rotated by the driving part and then pressing roller 4b is reciprocated in respect to feeding-out roller 4a.

The driving part for the sheet feeding-out mechanism 4 is controlled in this operation by the control part. The pressing roller 4b is spaced apart from feeding-out roller 4a and delayed while the rotation of feeding-out roller 4a stops. The pressing roller 4b moves toward feeding-out roller 4a after rising lever 3a, of adhering mechanism 3, is moved away. The feeding-out roller 4a is rotated only while oscillating supporting surfaces 2d, 2d of tape feeding-out mechanisms 2, 2, are positioned at both the corresponding right and left end sealing positions, and the packaging sheet A, positioned at the downstream end in the accumulating direction, and held between feeding-out roller 4a and pressing roller 4b, is fed out to sheet transporting mechanism 5. The packaging sheet A is fed out along feeding-out passage A' while being bent in a corrugated form. The pressing roller 4b moves away from feeding-out roller 4a after elevator 6 is lifted up to its upper limit position, and then it returns to its initial state.

The sheet transporting mechanism 5 is constructed such that transporting roller 5a and pressing roller 5b act as the upstream end sheet supporting means while holding a sheet in feeding-out passage A'. Each of a plurality of pressing rollers 5b, arranged at the adhering surfaces of adhering tapes C1, C2, C2, adhered at each of the corresponding sealing positions of the extreme end A1' of the packaging sheet A, is reciprocally arranged at a position that does not interfere with adhering tapes C1, C2, C2, as they pass in a direction moving toward or away from transporting roller 5a. The driving part, such as a stepping motor, is cooperatively related to transporting roller 5a and pressing roller 5b. The transporting roller 5a is rotated by the driving part, and further, pressing roller 5b is reciprocated against transporting roller 5a.

The driving part for the sheet transporting mechanism 5 is controlled in its operation by the control part. The pressing roller 5b moves away from transporting roller 5a and is delayed while transporting roller 5a stops rotating. The pressing roller 5b moves and presses against transporting roller 5a substantially in concurrence with the approaching movement of pressing roller 4b of sheet feeding-out mechanism 4. At the same time, packaging sheet A, fed out under the rotation of transporting roller 5a, is pushed out horizontally and transported up to the packaging starting position P1. After transported packaging sheet A is supplied to the downstream end sheet supporting means 5c, pressing roller 5b moves away from transporting roller 5a, the rotation of the transporting roller 5a stops and it returns to its initial state.

The downstream end sheet supporting means 5c is horizontally and laterally arranged in the right and left direction in substantially the same height as that of the upper end position of transporting roller 5a. The downstream end of the downstream end sheet supporting means 5c is bent upwardly at an angle. A feeding-out roller is provided for feeding out packaging sheet A from its upstream end toward the downstream end projected upwardly at an angle, as required.

The sliding surface 5d is arranged between transporting roller 5a and the downstream end sheet supporting means 5c, along the lower surface of the downstream end of feeding-out passage A', in such a way that it may be fed out in the sheet supplying direction. The sliding surface 5d is formed by material such as fluorine resin, which may be easily bent and slid. The length, in the sheet supplying direction, is longer than a distance from transporting roller 5a to the downstream end sheet supporting means 5c . At the same time, the length, in the right and left direction, is substantially the same length as that of the maximum length of packaging sheet A. In addition, sliding surface 5d is divided into a plurality of segments in the right and left direction so as not to interfere with transporting roller 5a. The sliding surface 5d is wound around transporting roller 5a, and the upstream end of sliding surface 5d, in the sheet supplying direction, is fixed to each of the winding rods 5e, and resiliently wound by a resilient member, such as a spring. The winding rods 5e are rotatably and laterally arranged below transporting roller 5a, and the downstream ends are fixed to upstream end winding guide 7.

At the packaging start position P1, reference guides 21, 21, positioned against each of a set of opposing side surfaces B1, B1 of contents B, and vertical reference surface 22, positioned against one of at least remaining side surfaces B2, B2, are arranged above elevator 6. When contents B are placed on the packaging starting position P1, enclosed by these members, side surfaces B1, B1, B2 of contents B abut against each of reference guides 21, 21 and reference surfaces 22, 22, and their positions are set.

The elevator 6 is laterally arranged before reference guides 21, 21 in such a manner that it may be reciprocated in a vertical direction. The width of mounting surface 6a, in the length direction of frame F, that is, in the supplying direction of packaging sheet A set by sheet transporting mechanism 5, is formed into a size where two maximum size pieces of contents B are mounted side-by-side in the sheet feeding direction. The length, in the right and left direction, is formed such that the maximum size contents B can be mounted in the right and left direction. At the same time, the driving part, such as a stepping motor, is cooperatively arranged to raise or lower mounting surface 6a.

The driving part of elevator 6 is controlled in its operation by the control part. The mounting surface 6a lifts up to its upper limit position and is delayed until the feeding-out of packaging sheet A. The mounting surface 6a descends down to a position near its lower limit, substantially in concurrence with the starting operation of feeding-out roller 4a of sheet feeding-out mechanism 4. The mounting surface 6a lifts up to its upper limit position just after winding guides 7, 7 move to a position just below reference guides 21, 21 so that mounting surface 6a is near winding guides 7, 7.

Then, as contents B are mounted on packaging sheet A, and sheet pressers 7b, 7b move away from upper surfaces 7a, 7a of winding guides 7, 7, upper surface B3 of contents B is lowered down to the lower limit position below winding guides 7, 7, and compressive receiving plates 8, 8. Subsequently, the upper surface B3 of contents B, raises by a predetermined amount until it forcibly contacts compressive receiving plates 8, 8. At the same time, it is slightly lowered after downstream side winding guide 7 projects up to the central upper positions of compressive receiving plates 8, 8. The mounting surface 6a raises or lowers in such a way that lateral folding guides 9 are opposed against the desired height positions of both side flaps A4 without any relation to the height size of contents B. The mounting surface 6a lifts upon completion of the advancement of pusher 10 and returns to its initial state.

A pair of winding guides 7, 7, for winding packaging sheet A around contents B, compressive receiving plates 8, 8, which can be projected into the raising or lowering passage 6e of elevator 6, opposing the upper surface of the lowered contents B, lateral folding guides 9, for folding each of both side flaps A4 of the expanded end parts A3, A3 of wound packaging sheet A, along each of the opened side surfaces B2, B2 of contents B, are arranged midway in the raising or lowering passage of the contents B, by elevator 6. The pusher 10 is provided for horizontally transporting contents B along mounting surface 6a of lowered elevator 6 toward the sheet supplying direction, and, at the same time, upper holding guides 11, 11, for holding lower flaps A5, A5 of expanded ends A3, A3 of the horizontally transported packaging sheet A, along the opened side surfaces B2, B2 of the contents B. The folding guides 12, 12 are arranged above upper holding guides 11, 11 in order to fold down upper flaps A6, A6 of expanded ends A3, A3 along the opened side surfaces B2, B2 of contents B.

The winding guides 7, 7 are formed of plates in which their upper surfaces 7a, 7a are kept substantially horizontal. Opposing inner ends 7b, 7b are parallel with side surfaces B1, B1 closed around lowered contents B. Their length, in the right and left direction, is longer than the length of the maximum size contents B. Resilient members 7c, 7c, such as a sponge or a leaf spring, are fixed to the lower surface of winding guides 7, 7. They may be arranged below reference guides 21, 21, and in such a manner that they may be reciprocated in a sheet supplying direction along upper surface B3 of lowered contents B. The driving part, such as a stepping motor, is cooperatively arranged to each of them, and they may be moved up and down and alternatively reciprocated by the driving part.

The driving parts for the winding guides 7, 7 are controlled in their operation, by the control part. The winding guides 7 are arranged at the upstream side in the sheet supplying direction during the initial state. Before the packaging sheet A is fed out toward transporting roller 5a of sheet transporting mechanism 5, by sheet feeding-out mechanism 4, it is delayed near transporting roller 5a, or at a position just below the reference guide 21. The winding guide 7, arranged at the downstream side, is delayed at each of the central upper positions of compressive receiving plates 8, 8. The downstream end winding guide 7 moves near downstream end supporting means 5c concurrently with the advancing movement of pusher 10. The upstream end winding guide 7 moves in the sheet supplying direction at the same speed as the supplying speed of packaging sheet A. This occurs after extreme end A1', of packaging sheet A, is pushed out and supplied by transporting roller 5a, and pressing roller 5b reaches upstream side winding guide 7. Then, upstream side winding guide 7 approaches the downstream side winding guide 7.

Extreme end A1', of the supplied packaging sheet A, moves from the upstream side winding guide 7 onto the downstream side winding guide 7, and from the downstream winding guide 7 onto the downstream supporting means 5c. Thereafter, each of both winding guides 7, 7 move in a counter sheet supplying direction up to the position just below reference guides 21, 21. Each of upper surfaces 7a, 7a move slightly upward as elevator 6 raises to its upper limit position. The inner ends 7b, 7b are arranged in substantially the same vertical plane as the upstream and downstream side surfaces B1, B1 of contents B in the sheet supplying direction. The winding guides 7, 7 move slightly down as elevator 6 descends, and project toward each other by a predetermined amount, just after elevator 6 descends to its lower limit position.

In addition, just after elevator 6 slightly rises and upper surface B3 of contents B is placed against compressive receiving plates 8, 8, the upstream side winding guide 7 projects to the central part of upper surface B3 of contents B. Thereby, downstream winding guide 7 projects, with a slight delay, toward upstream side winding guide 7. Upon completion of this movement, the upstream side winding guide 7 returns and moves in a counter sheet supplying direction. The downstream winding guide 7 projects up to the central upper positions of compressive receiving plates 8, 8, and returns to its initial state.

Further, upper surfaces 7a, 7a of winding guides 7, 7 are provided with sheet pressers 7d comprised of weights, in such a way that they may be moved toward and away in the vertical direction. These sheet pressers 7d are arranged so as not to interfere with the passing position of adhering tape C1 adhered to the packaging sheet A, and to interfere with the passing position of adhering tape C1 adhered to the upper surface 7a of the downstream side winding guide 7. At the same time, a superior feeding sheet is adhered to the bottom surface of the tape as required. Each of sheet pressers 7d is cooperatively related to driving parts 7e, 7e, such as solenoids, arranged above sheet pressers 7d. The sheet pressers 7d are moved up and down by driving parts 7e, 7e so that they move toward and away from upper surfaces 7a, 7a of winding guides 7, 7.

The driving parts 7e, 7e for sheet pressers 7d are controlled in their operations by the control part. The sheet pressers 7d are initially moved up before packaging sheet A is fed out to transporting roller 5a of sheet transporting mechanism 5. The sheet pressers 7d move away from upper surfaces 7a, 7a of the winding guides 7, 7, and down just below elevator 6 which has raised to its upper limit position. As sheet pressers 7d forcibly contact the upper surfaces 7a, 7a of winding guides 7, 7, they are moved up, under the operation of packaging start switch S2, and away from winding guides 7, 7. The sheet pressers 7d then move down just after elevator 6 descends to its lower limit position. The sheet pressers 7d forcibly contact upper surfaces 7a, 7a of winding guides 7, 7 and move up upon completion of the approaching of winding guides 7, 7, and return to their initial states.

The upper surfaces of compressive receiving plates 8, 8, are coated with a non-adhesive agent, such as silicone coating. The compressive receiving plates 8, 8 are arranged in such a manner that they may be reciprocated in the right and left direction between winding guides 7, 7 and upper surface B3 of the lowered contents B within passage 6b of elevator 6. The width in the sheet supplying direction, when the plates are projected at least into raising or lowering passage 6b, is substantially the same as the width in the sheet supplying direction of contents B. Both ends are arranged just above both ends of upper surface B3 of contents B in the sheet supplying direction. These compressive receiving plates 8, 8 are cooperatively related with the driving parts, such as a stepping motor, and each of the plates is moved in the right and left direction by these driving parts.

The driving parts for compressive receiving plates 8, 8 are controlled in their operations by the control part. The compressive receiving plates 8, 8 are delayed in the raising or lowering passage 6b of elevator 6. They do not interfere with the ascent of packaging sheet A and contents B when the elevator 6 is at the initial state and before packaging sheet A is fed out to transporting roller 5a of sheet transporting mechanism 5. As packaging starts, the plates project above contents B, descend just after the elevator 6 descends, thereby causing the right and left ends of upper surface B3 of contents B to engage each other. This results in winding guides 7, 7 approaching each other and, just after elevator 6 is slightly lowered, the plates return and move from above contents B, out of raising or lowering passage 6*b* of elevator 6, and return to their initial state.

The lateral folding guides 9 are arranged such that only the two guides are placed below winding guides 7, 7, and oppositely against the vertical intermediate positions of both side flaps A4. The side flaps A4, of the extending-out ends A3, A3, are on the same plane as the opened side surfaces B2, B2 of wound contents B. The lateral folding guides 9 are placed at the downstream side of contents B, in the sheet supplying direction, in such a manner that they may be reciprocated in the sheet feeding direction. At the same time, two guides, positioned at the downstream side from contents B, are arranged in such a manner that they may not be moved in the sheet supplying direction. Each of the lateral intermediate positions is rotatably supported in the folding direction of side flaps A4. Abutting portions 9*a* are opposed substantially parallel to closed side surfaces B1, B1, and at the initial state, are spaced apart from contents B, formed at one half of the linear inner surface opposed against contents B. The folding portions 9*b*, opposed and substantially parallel to side flaps A4, are initially spaced apart from contents B, formed at the other half of the inner surface.

In addition, lateral folding guides 9 move the folding portions 9*b* down toward lower flaps A5, A5 by the predetermined height of abutting portions 9*a*. The side flaps A4 abut each other, and each of the intermediate portions of the inner surfaces slides over four corners of side surfaces B1, B1, B2, B2 of contents B by a ¼ rotation. In the case that the extended length of each of extended end portions A3 are longer than half of the width of each of opened side surfaces B2, elevator 6 and upper folding guides 11, 11 descend by a predetermined height substantially corresponding to a descending amount of the folding portions 9*b*. In the case that the extended length of each of extended end portions A3 are shorter than half of the width of each of opened side surfaces B2, elevator 6 and upper folding guides 11, 11 ascend by a predetermined height in such a manner that the lower end of the lowered folding portions 9*b* reach the bottom surface B4 of the contents B.

The lateral folding guides 9, 9, at the upstream side, are cooperatively provided with the driving parts such as a stepping motor. These driving parts are operated by the control part. The abutting portions 9*a*, 9*a*, and folding portions 9*b*, 9*b*, are delayed at the positions where they may not interfere with the descent of packaging sheet A and contents B by elevator 6. The abutting portions 9*a*, 9*a* move in the same direction in substantial concurrence with the advancing movement of pusher 10. Thereby, they abut against the closed upstream side surface B1 of contents B. The folding portions 9*b*, 9*b* are located, and their advancing movements are stopped, at the positions near the rotated downstream lateral holding guides 9, 9. They are retracted toward the upstream side upon completion of transporting of contents B by pusher 10. Thereafter, returning projections 9*c*, 9*c* abut against and engage with folding portions 9*b*, 9*b* after their retraction. They are forcibly rotated in a reverse direction opposite to the folding direction and returned to their initial state.

The downstream side lateral folding guides 9, 9 have temporary holding portions 9*d*, 9*d*, such as permanent magnets or electromagnets. The abutting portions 9*a*, 9*a* are delayed substantially parallel with the closed downstream side surface B1 of contents B transported by pusher 10. At the same time, the lower ends of these abutting portions 9*b*, 9*b* are formed with slant cam surfaces 9*e*, 9*e*. As the side flaps A4, A4 are abutted, slant cam surfaces 9*e*, 9*e* rotate toward the folding direction and upward inclined sides 11*a*, 11*a* of ascending upper folding guides 11, 11 abut and engage each other. Thereby, these lateral folding guides 9, 9 forcibly rotate in a reverse direction opposite to the folding direction and return to their initial stages.

The pusher 10 is reciprocally arranged in the sheet supplying direction in opposition to the closed upstream-side surface B1 while passing vertically through elevator 6 and winding contents B. The upper end of vertical transporting surface 10*a* is arranged below compressive receiving plates 8, 8. At the same time, the driving part such as a stepping motor, is cooperatively arranged, and the pushing surface 10*a* is reciprocated by these driving parts.

The driving part for pusher 10 is controlled in its operation by the control part. The pushing surface 10*a* is delayed in the same vertical plane as upstream side surface B1 in the sheet supplying direction of contents B. The pushing surface 10*a* abuts to advance substantially in concurrence with the advancing of the upstream lateral folding guides 9, 9 toward the downstream side. It is stopped at the position where the closed downstream side surface B1 of contents B abuts against the downstream side lateral folding guides 9, 9. The pushing surface 10*a* moves forward again after the upstream side lateral folding guides 9, 9 are advanced to the desired positions of the opened side surfaces B2, B2 of contents B. It stops when it is advanced to the downstream side from the arranged position of the downstream side lateral folding guides 9, 9. It retracts toward the upstream side during ascent of elevator 6, or just after completion of the ascending operation, and returns to the initial state.

The upper folding guides 11, 11 are placed on the same horizontal surface as those of the opened side surfaces B2, B2 of wound contents B, and vertically arranged near the downstream side from the waiting positions of the downstream lateral folding guides 9, 9. Upper slant sides 11*a*, 11*a*, opposed against lower flaps A5, A5, are formed at the upper ends, and supported in such a way that they may be moved up and down. Upper slant sides 11*a*, 11*a* are adjusted and moved to be slightly higher than mounting surface 6*a*, during its descent, without relation to the amount of descent of elevator 6. Upon completion of the advancement of pusher 10, it ascends from the opened side surfaces B2, B2 of the contents B, and abuts against lower flaps A5, A5, transported by pusher 10, and folds along opened sides B2, B2. Further, it ascends at the same speed as that of elevator 6.

The folding guides 12, 12 are constructed such that supporting frames 12*b*, 12*b* are arranged above upper folding guides 12, 12 in correspondence with the variation in size of the length of contents B. The folding guides 12, 12, adjustably move in the right and left direction, and each of inner ends 12*a*, 12*a* supported at supporting frames 12*b*, 12*b* in such a way that they may be reciprocated in the right and left contacting direction. At the same time weights 12*c*, 12*c* are provided for applying a specified pressure to cause inner ends 12*a*, 12*a* to approach each other. Stoppers 12*d*, 12*d* prevent inner ends 12*a*, 12*a* from projecting to the upper surface B3 of contents B, due to the ascent of elevator 6. Thereby, its engagement is released, enabling inner ends 12*a*, 12*a* to be projected, and returning means 12*e*, 12*e*, for moving the projected inner ends 12*a*, 12*a*, in a reverse direction opposite to the projecting direction and engaging them with stoppers 12*d*, 12*d*.

An input means 23, such as a key pad, for inputting an outer shape and the size of each packaging sheet A and contents B, a sheet feeding-out starting switch S1, and a packaging start switch S2 are arranged at the upper surface of the device. The inputting means 23 communicates with sheet feeding-out mechanism 4 and sheet transporting mechanism 5 through the control part. The driving part for sheet feeding-out mechanism 4 and the driving part for sheet transporting mechanism 5 are controlled in response to the result of a calculation at the control part. The calculation includes reinputting the outer shapes and the sizes of packaging sheet A and contents B every time they are changed. Thereby, the amount of packaging sheet A fed-out is adjusted in such a manner that extreme ends A1′ of overlapped packaging sheets A are wound without being related to the change in size. The packaging sheet A may be arranged at the central position of the sheet supplying direction of upper surface B3 of contents B, and the winding ending form may become constant. At the same time, the inputted value is displayed to a displaying part 23*a* such as a CRT.

The sheet feeding-out start switch S1 and packaging start switch S2 communicate with the driving part for tape feeding-out mechanisms 2, 2, 2, the driving part for the adhering mechanism 3, the driving part for sheet feeding-out mechanism 4, the driving part for sheet transporting mechanism 5, the driving part for elevator 6, the driving part for winding guides 7, 7, the driving part for compressive receiving plates 8, 8, the driving part for lateral folding guides 9, the driving part for pusher 10, and the driving part for upper folding guides 11, 11. The sheet feeding-out start switch S1 is operated manually. Thereby, the driving part for tape feeding-out mechanisms 2, 2, 2, the driving part for adhering mechanism 3, the driving part for sheet feeding-out mechanism 4, and the driving part for sheet transporting mechanism 5 are operated in sequence to cause one sheet of packaging sheet A to be supplied to packaging start position P1.

The contents B are placed on the packaging start position P1, and packaging start switch S2 is operated manually. Thereby, the driving part for elevator 6, the driving part for winding guides 7, 7, the driving part for compressive receiving plates 8, 8, the driving part for lateral folding guides 9, the driving part for pusher 10, and the driving part for upper folding guides 11, 11 are operated in sequence. Concurrently, with the starting of the packaging of contents B, the driving part for tape feeding-out mechanisms 2, 2, 2, the driving part for adhering mechanism 3, the driving part for sheet supplying mechanism 4, and the driving part for sheet transporting mechanism 5 are operated in sequence and the next packaging sheet A is supplied to the packaging start position P1.

In addition, the packaging completing position P2, downstream from packaging start position P1, is arranged near folding guides 12, 12, at the supporting means that resiliently project along the bottom surface B4 of contents B, which have been raised by elevator 6. Thus, the supporting means comprise latches 13, having a small projection toward the right and left ends of the bottom surface B4, through resilient members 13*a*, such as springs, from supporting frames 12*b*, 12*b* of folding guides 12, 12. The supporting means also comprise a latch 14 having a large projection toward a substantially central part of the bottom surface B4. The contents B is fed in or out to recess 6*c* formed at the downstream end of mounting surface 6*a*. The upper end surfaces of latches 13, 14 are arranged at substantially the same height as that of the surface of folding guides 12, 12. The bottom surface B4 of contents B is supported while being projected.

The latch 14 includes a large projection constructed such that a rising piece 14*b*, is arranged on base 14*a*, lower than the lower limit position of mounting surface 6*a*. The rising piece 14*b* may be resiliently located in the sheet supplying direction. The resilient member 14*c*, such as a spring, is placed between rising piece 14*b* and side surface F3 of the frame to always press rising piece 14*b* toward the upstream-side.

The packaging device operates as follows. First, the sheet supplying start switch S1 is manually operated, and tape feeding-out mechanisms 2, 2, 2 feed out each of adhering tapes C1, C2, C2 to each of oscillating supporting surfaces 2*d*, 2*d*, 2*d*, which support them. Subsequently, raising lever 3*a* of adhering mechanism 3 and pressing sheet 1*d* move in a bending direction while holding extreme ends A1 of upward bent packaging sheets A. As shown in FIG. 4(*a*), packaging sheets A are bent along abutting guide 1*f*, and at the same time, extreme end A1′ of packaging sheet A positioned at the downstream end in the accumulating direction forcibly contacts oscillating supporting surfaces 2*d*, 2*d*, 2*d*. Each of adhering tapes C1, C2, C2 partially project and partially adheres at the corresponding feeding positions, arranged at the central part of extreme ends A1′, and both right and left ends When the position of extreme end A1′ is detected by sensor 1*h*, and extreme end A1′ does not reach up to the setting position, stopper 1*g* moves to push out the accumulated packaging sheets A along pressing sheet 1*d*. Thereby, extreme end A1′ of the downstream side packaging sheet A reaches the setting position. Concurrently, wedge lever 3*b* partially holds extreme ends A1, of packaging sheets A, with resilient members 3*d*, 3*d* and forcibly presses them against the lower part of feeding-out roller 4*a*. Thus a part of each of extreme ends A1′ is bent along the outer circumferential surface of feeding-out roller 4*a*.

The cutter 2*c* of tape feeding-out mechanism 2, corresponding to the central sealing position, projects, as shown in FIG. 3, to cut adhering tape C1. Thereby, with a slight delay, oscillating supporting surface 2*d* projects toward feeding-out passage A′ of packaging sheet A to adhere adhering tape C1 over the entire right and left direction.

Thereafter, raising lever 3*a* gradually starts its movement toward the reverse direction. The raising lever 3*a* slowly moves away from oscillating supporting surfaces 2*d*, 2*d*, 2*d* as shown in FIG. 4(*b*). The raising lever 3*b* partially holds extreme ends A1 of packaging sheets A by resilient members 3*d*, 3*d* and continues to forcibly press against the lower part of feeding-out roller 4*a*. This results in application of a recovering force, to return in a counter-bending direction applied to upper extreme ends A1′, and causing the other accumulated extreme ends A1′ to be forcibly pulled apart from extreme end A1′, of the downstream end packaging sheet A adhered to adhering tapes C1, C2, C2. Then they enter between these members to release their close contact position.

This pulling-out operation is effective when the accumulated amount of the packaging sheets is small. The packaging sheets can be positively separated up to the final sheet. Thereafter, wedge lever 3*b* also moves away from the lower part of feeding-out roller 4*a*, as shown in FIG. 4(*c*), and returns, together with raising lever 3*a*, in a counter-bending direction. During this returning operation, oscillating pieces 3*c*, 3*c* abut against fixed stoppers 3*e*, 3*e*, and wedge lever 3*b* oscillates in a direction moving apart from the lower part of feeding-out roller 4*a*.

Subsequent to this operation, pressing roller 4*b* enters, as shown in FIG. 4(*d*), between the entire extreme ends A1 of packaging sheets A returned in a counter-bending direction and extreme end A1 of the downstream end of packaging sheet A, and forcibly contacts feeding-out roller 4*a*. Thereafter, cutters 2*c*, 2*c* of tape feeding-out mechanisms 2, 2, opposing both the right and left corresponding sealing positions, project to cut adhering tapes C2, C2. Just after this operation, each of the oscillating supporting surfaces 2*d*, 2*d* project toward feeding-out passage A'. Concurrently, feeding-out roller 4*a* rotates to cause the downstream end raising sheet A, having adhering tapes C1, C2, C2 adhered thereto, to feed out toward the sheet transporting mechanism 5 along feeding-out passage A'.

With a small delay, extreme end A1' of fed-out packaging sheet A advances between transporting roller 5*a* and pressing roller 5*b* of sheet transporting mechanism 5. The packaging sheet A is supplied horizontally toward the packaging start position P1 under the rotation of transporting roller 5*a*. The sliding surface 5*d* slides against supporting roller 5*a* and is not fed out.

As extreme end A1', of the fed-out and supplied packaging sheet A, reaches near supporting roller 5*a*, or upstream side winding guide 7, waiting just below the reference guide 21, and the upstream side winding guide 7 starts to move in the sheet supplying direction at the same speed as the supplying speed of packaging sheet A. Concurrently, sliding surface 5*d*, fixed to the upstream side winding guide 7, is also pulled in the sheet supplying direction. Thereby, sliding surface 5*d* is rewound from winding rod 5*e*, and pulled out in the sheet supplying direction along the lower surface at the downstream side of feeding-out passage A'. The sliding surface 5*d* moves at the same speed as the supplying speed of packaging sheet A.

Accordingly, packaging sheet A is supported on sliding surface 5*d*, pushed out and supplied without being downwardly loosened. Thereafter, the upstream side winding guide 7 moves near the downstream side winding guide 7, and stops. The extreme ends A1' move from sliding surface 5*d* onto the downstream side winding guide 7, then onto the downstream side supporting means 5*c*. At the same time, extreme end A1' is guided, as shown in FIG. 1, upwardly and at an angle, along the downstream side supporting means 5*c*. Thereby, the transporting through the transporting roller 5*a* is completed.

Upon completion of the supplying of the packaging sheet A, elevator 6 ascends to its upper limit position, and winding guides 7, 7 move to the positions just below reference guides 21, 21 which are moved slightly upwardly, as shown in FIG. 1. Thereafter, sheet pressers 7*d* move downwardly to hold packaging sheet A, supplied between upper surfaces 7*a*, 7*a* of winding guides 7, 7. This prevents the positional displacement of packaging sheet A. As contents B are positioned on packaging sheet A, packaging sheet A bends in response to the weight of contents B, causing lower surface B4 of contents B to abut against mounting surface 6*a* of elevator 6.

Thereafter, upon manual operation of packaging start switch S2, sheet pressers 7*d* are moved upwardly to release the holding of packaging sheet A, and elevator 6 starts to descend. Thereby, packaging sheet A is held in a substantial U-shape along bottom surface B4 of contents B, and both sides B1, B1, as shown in FIG. 5(*a*). Upon stopping the descent of elevator 6, sheet pressers 7*d* are moved downwardly to hold packaging sheet A between upper surfaces 7*a*, 7*a* of winding guides 7, 7. Substantially in concurrence with this operation, compressive receiving plates 8, 8 project above contents B.

Subsequently, after winding guides 7, 7 project by a predetermined amount in their approaching directions, elevator 6 slightly ascends, as shown in FIG. 5(*b*), to cause outer surfaces B3 of contents B to engage compressive receiving plates 8, 8. At the same time, contents B are held between mounting surface 6*a* and compressive receiving plates 8, 8 in such a manner that contents B may not be moved. The contents B are compressed in a vertical direction, thereby, each of both side surfaces B1, B1 of contents B, and packaging sheet A, opposed these side surfaces, are loosened in a vertical direction. Upstream side winding guide 7 projects, as shown in FIG. 5(*c*), and subsequently the downstream end winding guide 7 projects, as shown in FIG. 5(*d*).

With such an arrangement, each of extreme end A1 and end part A2, of packaging sheet A, is wound and closely contacts, in U-shape, upper surfaces 7*a*, 7*a* of winding guides 7, 7, inner ends 7*d*, 7*d* and resilient members 7*c*, 7*c*. A loose end portion of packaging sheet A is pulled upwardly and its winding is fastened. As winding guides 7, 7 are protected, after the loosening of packaging sheet A is eliminated, the tension applied to packaging sheet A is larger than the frictional resistance between packaging sheet A and winding guides 7, 7. This results in packaging sheet A being pulled out from between upper surfaces 7*a*, 7*a* of winding guides 7, 7 and sheet pressers 7*d*. End portions A2, of packaging sheet A, are first folded along upper surface B3 of contents B, as shown in FIG. 5(*c*).

Then, extreme end A1, of packaging sheet A, is also pulled out as shown in FIG. 5(*d*). At this time, the adhering surface of adhesive tape C1 adheres to the bottom surface of the downstream side sheet presser 7*d*, which is arranged so as to interfere with the passing position of adhering tape C. Adhering tape C is adhered in advance to cause the leading end A1' to be stop. Thereby, packaging sheet A is further fastened and folded along the upper surface B3 of contents B. At the same time, folded end A2', and end portion A1', while being drawn, are pushed against upper surface B3 of contents B by resilient members 7*c*, 7*c*, so as to prevent each of them from being pulled out.

Figure 6:
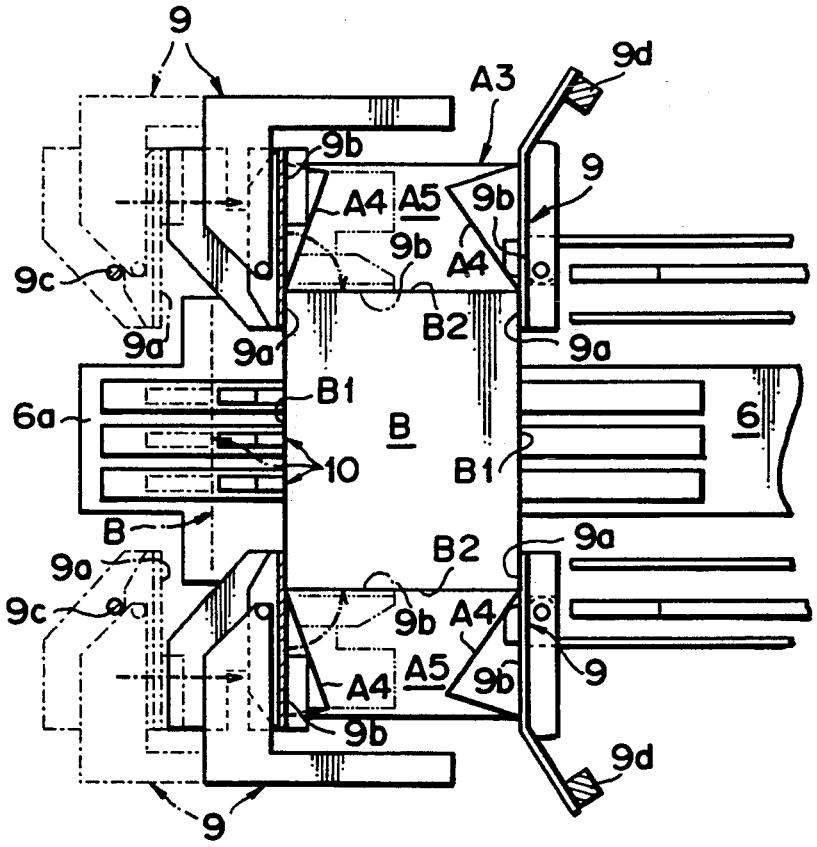
FIG. 6 is a partial enlarged cross sectional top plan view showing the folding starting state of the side flap.

Subsequently, sheet pressers 7*d* move upwardly, as shown in FIG. 5(*e*). The downstream side winding guide 7 projects up to the central upper positions of compressive receiving plates 8, 8, as shown in FIG. 5(*f*). The extreme end A1' of the packaging sheet overlaps on the outside of end portion A2', and at the same time, overlapped end A2' and end A1' are held by lower resilient member 7*c* of the downstream side winding guide 7 and the upper surface B3 of contents B. The projected portions of adhering tapes C1, C2, C2, adhered to extreme end A1', push against end A2', so as to seal them Subsequently, elevator 6 descends slightly, as shown in FIG. 5(*g*). The compression of contents B is loosened, and compressive receiving plates 8, 8 are pulled out to complete the winding stage. Thereafter, contents B are transported, under the advancing movement of pusher 10, and, as shown in FIG. 6, side surface B1 of the closed downstream side abuts against abutting portions 9*a*, 9*a* of the downstream side lateral folding guides 9, 9. At this time, contents B are held, and the position is immovably set between the temporary stopped pusher 10 and the downstream side. Abutting portions 9*a*, 9*a*, which are temporarily held by the temporary holding portions 9*d*, 9*d*.

Under this condition, each of abutting portions 9*a*, 9*a* abuts against the winding closed downstream side surface B1 of contents B. The folding portions 9*b*, 9*b* descend toward lower flaps A5, A5 of the expanding end portions A3, A3. Each of the inner surface intermediate portions slides, by a ¼ rotation, over the corners between the upstream side surface B1 and the opened side surfaces B2, B2. Thereby, the entire upstream side flaps A4, A4 are pulled downwardly. While pressing against the corner, the upper portions of the base ends of side flaps A4, A4 are tightly folded along the opened side surfaces B2, B2 of contents B.

Subsequently, contents B are transported again by pusher 10. The folding portions 9*b*, 9*b* descend toward lower flaps A5, A5, as the inner surface intermediate portions of the downstream side lateral folding guides 9, 9 slide, by a ¼ rotation, over the corners between the downstream side surface B1 and opened side surfaces B2, B2. Thereby, the entire downstream side flaps A4, A4 are pulled downwardly, and the upper portions of base ends of these side flaps A4, A4 are tightly folded while being pressed against the corners.

The contents B pass between the inner surfaces of the abutted and rotated lateral holding guides 9, and are guided to the downstream side of the mounting surface 6*a*. The base end portions of lower flaps A5, A5 abut against upper slant sides 11*a*, 11*a* of upper folding guides 11, 11 slightly higher than mounting surface 6*a* of elevator 6, and are folded. Thereby, folded side flaps A4 are prevented from being loosened.

Figure 7:
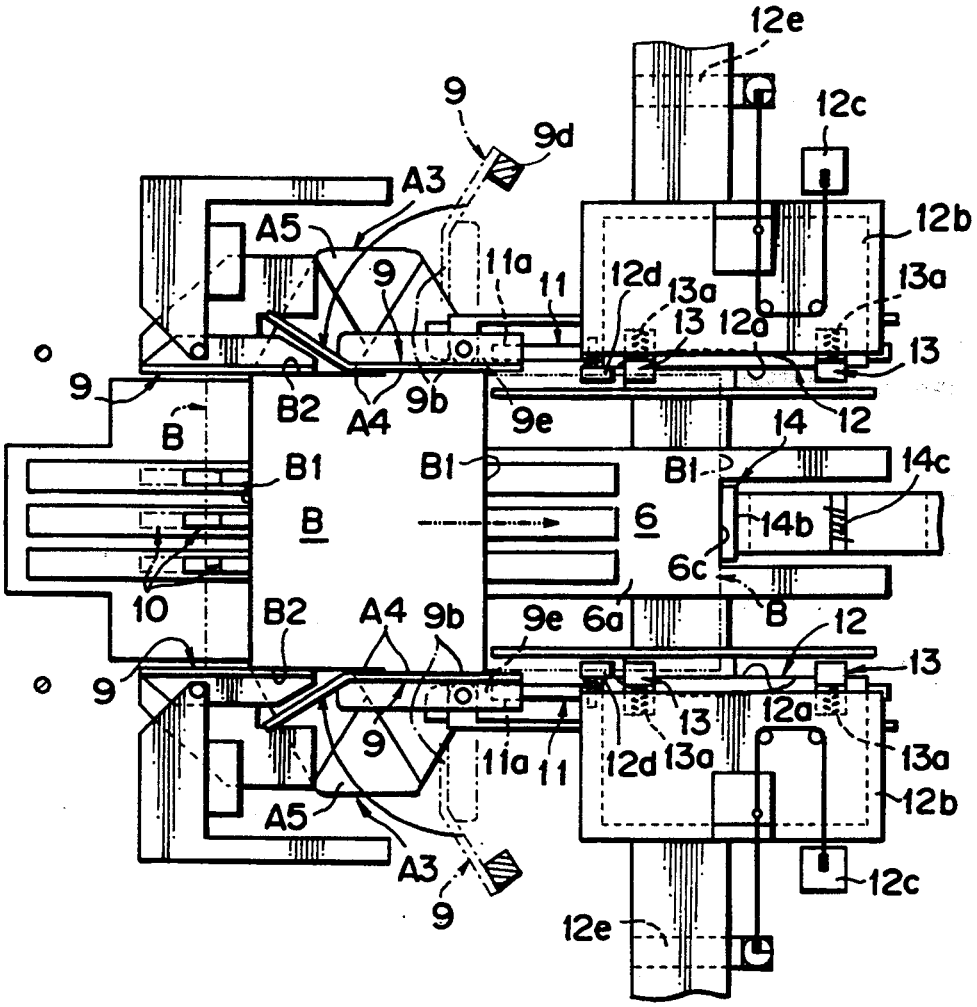
FIG. 7 is a partial enlarged cross sectional top plan view showing the state just before the completion of the folding of the side flap.

Subsequently, the closed downstream side surface B1 of contents B are transported by pusher 10 to abut against a rising piece 14*b*, of latch 14 projecting at the upstream end, as shown by a two-dotted line in FIG. 7. Its subsequent transportation causes contents B to push downwardly while rising piece 14*b* is pressed against the closed downstream side surface B1. When contents B reaches the predetermined position, the advancing movement of pusher 10 is completed.

Figure 8:
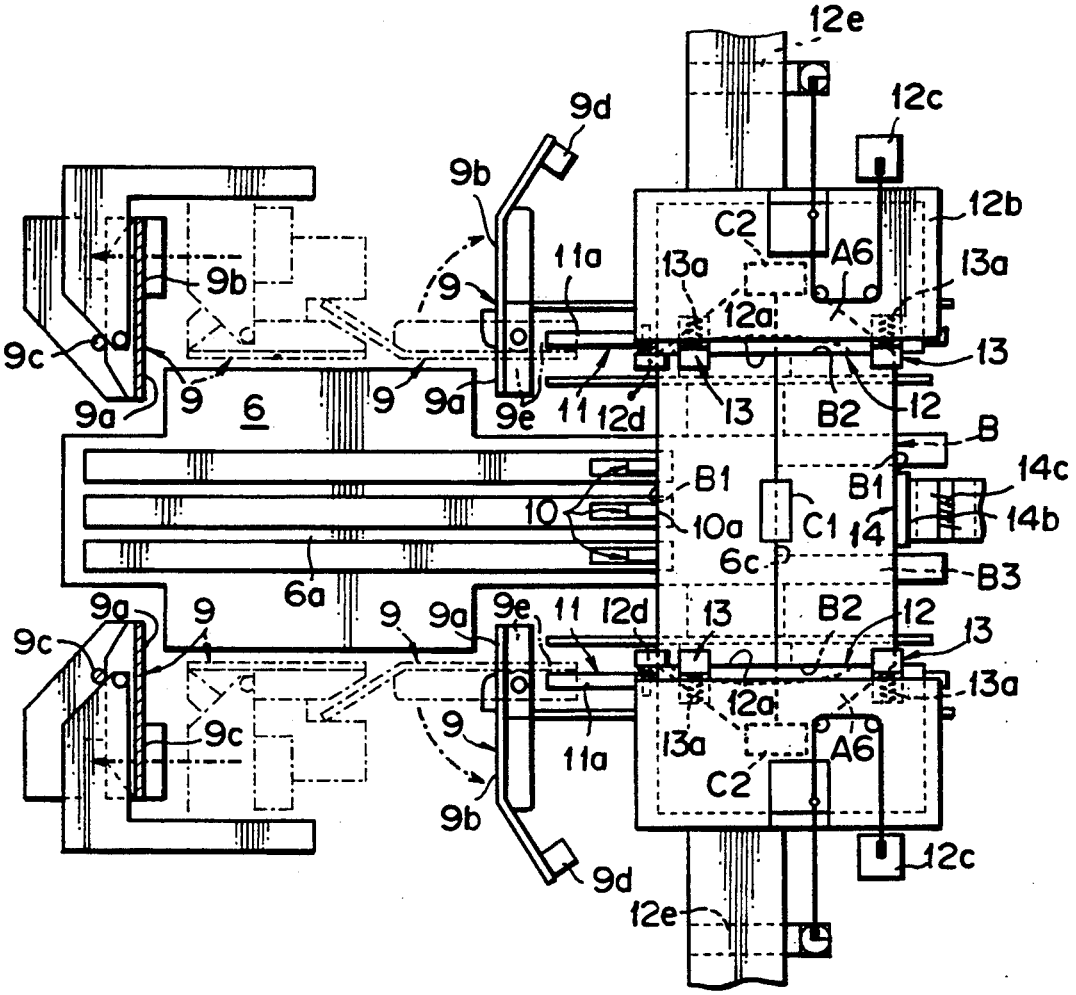
FIG. 8 is a partial enlarged cross sectional top plan view showing a folding-down starting state of the upper flap.

Substantially concurrent with this operation, upstream side lateral folding guides 9, 9 abut against, and engage with, returning projections 9*c*, 9*c*, as shown in FIG. 8. During their retracting operation, the upstream side lateral folding guides 9, 9 are forcibly rotated in a reverse direction and returned to their initial state. Subsequently, upper folding guides 11, 11 ascend causing lower flaps A5, A5 to fold outside flaps A4. Concurrently, upper slant sides 11*a*, 11*a* abut against, and engage with, slant cam surfaces 9*e*, 9*e* of the downstream side lateral folding guides 9, 9. Thereby, the downstream side lateral folding guides 9, 9 forcibly rotate in a reverse direction and return to their initial state.

Subsequently, mounting surface 6*a* of elevator 6 ascends and pushes contents B up along pushing surface 10*a*, which is advanced and stopped by rising piece 14*b* of latch 14. The folding guides 11, 11 ascend, and the upper surface B3 of ascending contents B strikes against stoppers 12*d*, 12*d* of folding guides 12, 12. This results in inner ends 12*a*, 12*a* of folding guides 12, 12 pushing against the opened side surfaces B2. B2 of contents B at a specified pressure caused by weights 12*c*, 12*c*.

The upper flaps A6, A6 gradually fold down while being downwardly rubbed, and overlapped on the outside of lower flaps A5, A5, as shown in FIG. 1. In the case that the projecting length of upper flaps A6, A6 is shorter than the height of contents B, adhering tapes C2, C2, adhered to extreme ends of upper flaps A6, A6, while being tensioned downwardly by the inner ends 12*a*, 12*a* of folding guides 12, 12 adhere to lower flaps A5, A5. Thereby, the sealing and edge folding step is completed. In addition, in the case that the projecting length of upper flaps A6, A6 is longer than the height of contents B, and the extreme ends of flaps A6, A6, upon completion of the folding-down operation, project downwardly from the bottom surface B4 of contents B, inner ends 12*a*, 12*a* of folding guides 12, 12, by weights 12*c*, 12*c*, project along the bottom surface B4 of contents B, when the ascending contents B completely pass between inner ends 12*a*, 12*a* of folding guides 12, 12. Thereby, latches 13 project by a small amount along the right and left ends of bottom surface B4. Also, rising piece 14*b* of latch 14, projects, by a large amount, along bottom surface B4, near the central part.

When mounting surface 6*a*, of elevator 6, descends after contents B is supported by latches 13, 14, inner ends 12*a*, 12*a* of folding guides 12, 12 project further by weights 12*c*, 12*c*. Extreme ends of upper flaps A6, A6 fold along bottom surface B4 of contents B. At the same time, they are adhered and sealed by adhering tapes C2, C2.

Contents B, of which folding is completed, starts its packaging when elevator 6 starts to descend even if the folding guides 12, 12 are moved in a removing direction to each other. They are supported by latches 13, 14 so that they are not raised. In the case that the next contents B is packaged without removing the contents B of which packaging is completed, these contents B are piled on latches 13.

In addition, when the size of packaging sheets A changes, the control part automatically adjusts and moves side guides 1*b*, 1*b* or stopper 1*g* in response to the inputted size data. As side guides 1*b*, 1*b* are moved, tape feeding-out mechanisms 2, 2 corresponding, to the sealing positions at the right and left ends, are moved in the right and left direction. Then, the amount of packaging sheet A fed by the sheet feeding-out mechanism 4, and the sheet transporting mechanism 5 is automatically changed.

In the case that the outer shape, height and size of the contents B are changed, the control part automatically changes the amount of the packaging sheet A fed-out by sheet feeding-out mechanism 4 and sheet transporting mechanism 5. The amount of elevator 6 lowers, and the height position of upper folding guides 11, 11, also automatically change when the width of contents B is changed. The control part automatically changes the amount of packaging sheet A fed-out by sheet feeding-out mechanism 4 and sheet transporting mechanism 5.

Each of reference guides 21, 21 and winding guides 7, 7 are moved in the sheet supplying direction, and the spacing is automatically changed. When the length of contents B is changed, each of upper folding guides 11, 11 and folding guides 12, 12 are moved in the right and left direction and their spacing is automatically changed.

In the preferred embodiment, packaging sheet A is folded in a substantially U-shape along both side surfaces B2, B2 of contents B, under the descent of the elevator 6, and is wound. The preferred embodiment is not limited to this form. The upper surface of contents B may abut upwardly against the packaging sheet, supplied as elevator 6 ascends. Thereby, packaging sheet A may be folded in an inverse U-shape along both side surfaces B1, B1 of contents B, and wound.

The lower flaps A5, A5 are folded up, and thereafter upper flaps A6, A6 are folded down to be overlapped on the outside of lower flaps A5, A5. The preferred embodiment is not limited to this form. For example, after the upper flaps A6, A6 are folded down by the folding-down guides arranged between downstream side lateral folding guides 9, 9 and upper folding guides 11, 11, lower flaps A5, A5 are folded and overlapped by upper folding guides 11, 11. The extreme ends of these lower flaps A5, A5 may be sealed by the adhering tapes, adhered in advance, and the extreme ends of the folded up lower flaps A5, A5 may be sealed by the adhering tapes, adhered in advance, after folding along upper surface B3 of contents B through the projecting movements of folding guides 12, 12.

The present invention has the following advantages.

The corresponding sealing position of the packaging sheet is moved toward and away from the adhering tape fed out from the tape feeding-out mechanism by the adhering mechanism. Thereby, a part of the adhering tape projects and adheres to the corresponding sealing position. Thereafter, the packaging sheet, having the adhering tape adhered thereto, is fed out by the sheet feeding-out mechanism to the packaging start position. Thereby, concurrently with the completion of the folding of the packaging sheet during the packaging process, the projected part of the adhering tape adheres, and the sealing can be performed simultaneously while the packaging sheet is being packaged.

Accordingly, as compared with the prior art packaging device, in which each of the adhering tapes is fed out upon completion of the winding and the folding, and adhered to the corresponding sealing position of the packaging sheet, an exclusive stage for adhering tapes during the packaging stage of the contents B is not necessary. At the same time, the tape feeding-out mechanism and the adhering mechanism are not required to be arranged at the positions opposed to the overlapped ends of the wound packaging sheet or the position opposed to the lower flap extreme end of each of the folded and fed-out ends. This results in a small device with a simple structure.

The adhering mechanism moves the extreme end of the packaging sheet while the sheets are being accumulated, and abuts the sheet against the adhering tape, fed out and supported by, the tape feeding-out mechanism. Thereby, only the extreme end of the packaging sheet located at the downstream end, in its accumulating direction, is held. Thereafter, the extreme end of the packaging sheet is moved in a counter-bending direction, and away from the tape feeding-out mechanism. Thereby, a recovering force of the packaging sheet, returning in the counter-bending direction, is utilized. An entire extreme end of the downstream side packaging sheet, held at the adhering tape from the extreme end of the other accumulated packaging sheet, is forcibly pulled out. No adhering force or frictional force is utilized, and only one downstream side packaging sheet can be separated.

As compared with the prior art packaging device, which requires a separating means utilizing adhering or frictional force to perform a positive separation of only one packaging sheet, positioned at the downstream end in the accumulating direction, from the entire accumulated packaging sheets, the present invention does not require any separate arrangement of the separating means. Its structure is simplified and the entire device can be made small.

The packaging sheets are bent while being accumulated between the raising or lowering passage of the elevator. The bottom surface and side surfaces of the frame, the lower part and side parts of the raising or lowering passage form a continuous sheet arranging space. At the same time, each of the extreme ends of the accumulated packaging sheets are displaced from each other to form an acute angle. In this positional displacement, cross contact of the packaging sheets can be prevented so that the maximum sheet arranging space is assured, while only one downstream end packaging sheet may easily be separated without utilizing any adhering force or frictional force.

Accordingly as compared with the prior art packaging device, having a paper feeding table where the packaging sheets are accumulated at an angle, while being kept in their linear line state, and the raising or lowering passage of the elevator is arranged side-by-side in a lateral direction, the present invention can store a long packaging sheet in a compact manner without changing the size of the entire device in a lateral and vertical direction, for the packaging sheet.

A part near the extreme end of the bent packaging sheet is detected by a sensor. It is moved when its position does not reach the set position. Thereby, the extreme end of the packaging sheet is pushed out and the extreme end reaches the set position. Thereby, the downstream side packaging sheet can be kept at the specified position without moving the packaging sheet up and down in relation with the accumulated amount.

Accordingly, compared with the prior art system, in which the accumulated packaging sheets are moved up and down, and the packaging sheet located at the downstream end is maintained at the desired height without being related to the accumulated amount, the present invention provides a compact entire device a simplified structure and the packaging sheet are more easily supplied and its cost can be reduced.

The slipping surface is moved in the sheet supplying direction to pull out the packaging sheet concurrently with the extreme end of the packaging sheet, which is supplied in the sheet supplying direction from the downstream end sheet supporting means. Thereby, the packaging sheet is supported on the slipping surface, and applied over the downstream end sheet supporting means without being displaced downwardly. Thereby, the packaging sheet can be supplied without being supported in the sheet supplying direction, and the feeding mechanism such as a feeding belt may not be laterally arranged in the sheet supplying direction, so the structure is simplified, and correspondingly its cost can be reduced.

We claim:

1. A packaging apparatus, for supplying a packaging sheet that covers an outer surface of the contents to be packaged, said apparatus comprising:

an elevator for supporting said contents and said sheet while said sheet is disposed between said contents and said elevator;

a tape feeding-out mechanism for feeding-out adhering tape toward the packaging sheet before the packaging sheet is supplied and supported;

an adhering mechanism, movable toward and away from the fed-out adhering tape, and capable of adhering the adhering tape to a corresponding sealing position of the packaging sheet, with one part of the adhering tape being projected, while the packaging sheet and said contents are placed on said elevator and transported in a vertical direction during the raising or lowering of the elevator from a packaging start position at which said packaging sheet is in a substantially extended condition;

a sheet feeding-out passage positioned toward the packaging start position;

a sheet feeding-out mechanism, for supplying the packaging sheet, adhered with the adhering tape, above said elevator and along said sheet feeding-out passage.

2. The packaging apparatus according to claim 1, wherein the packaging sheet is wound around the contents in a tubular form; and said adhering mechanism is capable of adhering the adhering tape at the corresponding sealing position with one part of the adhering tape being projected, at one end, in the winding direction, of the packaging sheet, which is overlapped on the outside of the contents by the winding operation.

3. The packaging apparatus according to claim 2, further comprising:

means for controlling said sheet feeding-out mechanism, wherein the winding operation is carried out independent of change in the size of the packaging sheet for the contents, and the extreme ends of the overlapped packaging sheets, at the outside of the contents, are arranged at a central position in the sheet supplying direction of the contents.

4. The packaging apparatus according to claim 2, wherein said tubular form comprises tubular end portions which project beyond said opened side surfaces of said contents in a rectangular form said packaging apparatus further comprising:

means for holding each of said tubular end portions in a rectangular, tubular form, from the opened side surface of the contents; and wherein said adhering mechanism is capable of adhering the adhering tape at the corresponding sealing position including, a part projected at the extreme end of each of the overlapped packaging sheets; and the outermost part of the sheet is crossed and at a right angle in the winding direction and folded.

5. The packaging apparatus according to claim 1, further comprising:

a raising or lowering passage for said elevator;

a frame including side surfaces and a bottom surface; and;

wherein the extreme ends of the packaging sheets are bent upwardly along said side surfaces of said frame while being accumulated;

said tape feeding-out mechanism is arranged to oppose against the extreme end of the packaging sheet positioned at the downstream end in the bent, accumulating direction;

the extreme ends of the bent, accumulated packaging sheets are capable of moving in a bending direction and in a counter-bending direction;

said adhering mechanism is reciprocally arranged and movable toward and away from the adhering tape fed out by said tape feeding-out mechanism; and said sheet feeding-out mechanism is capable of separating the accumulated packaging sheets one-by-one.

6. The packaging apparatus according to claim 5, further comprising:

a stopper abutting against the extreme end of the packaging sheet reciprocally arranged toward the extreme end of the bent packaging sheet; and a sensor arranged near the extreme end of the packaging sheet bent by the adhering mechanism;

wherein said stopper is adjustable and movable in response to an output from said sensor.

7. The packaging apparatus according to claim 5, wherein said adhering mechanism is capable of changing the movement of the packaging sheet from its bending direction to its counter bending direction; and said apparatus further comprises means for partially folding an extreme end of the bent, accumulated packaging sheet in the counter-bending direction.

8. The packaging apparatus according to claim 1, wherein said sheet feeding-out passage includes a downstream end and a lower surface, and said elevator includes a raising and lowering passage, and said packaging apparatus further comprises:

means for supporting the packaging sheet extending in a direction crossing at a right angle with the sheet supplying direction while holding said raising or lowering passage of said elevator; and a slipping surface arranged over said means for supporting the packaging sheet along said lower surface of said sheet feeding-out passage;

wherein said slipping surface is capable of being fed in or out in a sheet supplying direction; said downstream end is arranged to be crossed at a right angle with said raising or lowering passage of said elevator; and said slipping surface is capable of cooperating with the supplying of the packaging sheet and moving in the sheet supplying direction.

9. A packaging device comprising:

a frame including a bottom surface and side surfaces;

an elevator including a mounting surface and a raising or lowering passage;

a sheet feeding-out mechanism capable of separating accumulated packaging sheets one-by-one and supplying a packaging sheet above said elevator, wherein the packaging sheet covers the outer surfaces of the contents in a winding operation conducted while the packaging sheet and the contents are mounted on said mounting surface of said elevator, while said elevator moves in a vertical direction from the packaging start position at which said packaging sheet is in a substantially extended condition; and a sheet feeding-out passage;

wherein the accumulated packaging sheets are stored and arranged in a substantially horizontal manner along said bottom surface of said frame below said raising or lowering passage of said elevator; the extreme ends of the accumulated packaging sheets are bent upwardly along said side surface of said frame while being accumulated; and said sheet feeding-out passage is arranged from the extreme ends of the packaging sheets to a position near the elevator.

10. The packaging apparatus according to claim 9, further comprising:

a stopper abutted against the extreme end of the packaging sheet capable of being reciprocated toward the extreme end of the bent packaging sheet along said bottom surface of said frame;

a sensor arranged near the extreme end of the bent packaging sheet, wherein said stopper is adjustable and movable in response to an output from said sensor.

11. The packaging apparatus according to claim 9, wherein said sheet feeding-out passage includes a downstream end arranged to be crossed at a right angle with said raising or lowering passage of said elevator and a lower surface, and said apparatus further comprises:

a pair of sheet supporting means extending in a direction crossing at a right angle with the sheet supplying direction and laterally arranged with said ascending or descending passage of said elevator;

a slipping surface arranged at said sheet supporting means and capable of being fed out or fed in the sheet supplying direction along said lower surface of said sheet feeding-out passage.

12. The packaging apparatus according to claim 9, further comprising:

a tape feeding-out mechanism for feeding-out adhering tape toward the packaging sheet before the packaging sheet is supplied and supported.

13. The packaging apparatus according to claim 12, further comprising:

an adhering mechanism, movable toward and away from the fed-out adhering tape, and capable of adhering the adhering tape to a corresponding sealing position of the packaging sheet, with one part of the adhering tape being projected.

14. The packaging apparatus according to claim 9, further comprising:

means for controlling said sheet feeding-out mechanism, wherein the winding operation is carried out independently of change in the size of the packaging sheet for the contents.

15. The packaging apparatus according to claim 9, wherein said tubular form comprises end portions which project beyond said opened side surfaces of said contents in a rectangular form said packaging apparatus further comprising:

means for holding each of said tubular end portions of the packaging sheet projecting in a rectangular, tubular form, from the opened side surface of the contents.

16. The packaging apparatus according to claim 9, wherein the extreme ends of the packaging sheets are bent upwardly along said side surfaces of said frame while being accumulated; and the apparatus further comprises:

means for partially folding an extreme end of the bent, accumulated packaging sheet in the counter-bending direction.

17. A method of packaging a contents comprising:

supplying a contents to be packaged;

feeding-out an adhering tape;

supplying a packaging sheet;

adhering the adhering tape to a corresponding sealing position on the packaging sheet;

cutting the adhering tape;

supplying the packaging sheet adhered with adhering tape along a sheet feeding out passage;

adhering the adhering tape at the corresponding sealing position with one part of the adhering tape being projected at one end of the packaging sheet;

packaging the contents by winding the packaging sheet around the contents in a tubular form thereby overlapping the packaging sheet; and folding and sealing the overlapped ends of the packaging sheet.

18. The method according to claim 17, wherein said winding of the packaging sheet is carried out independently of the size of the packaging sheet.

19. A method of packaging a contents comprising:

supplying a contents to be packaged;

feeding-out an adhering tape;

supplying a plurality packaging sheets in a frame;

adhering the adhering tape to a corresponding sealing position on the packaging sheet;

cutting the adhering tape;

bending the ends of the plurality of packaging sheets in said frame;

separating the packaging sheets one-by-one;

supplying the packaging sheet adhered with adhering tape along a sheet feeding out passage; and packaging said contents by contacting said contents with a separate packaging sheet.

20. The method according to claim 19, further comprising:

changing the direction of the packaging sheet from its bending direction to its counter bending direction.

* * * * *

UNITED STATES PATENT AND TRADEMARK OFFICE

CERTIFICATE OF CORRECTION

PATENT NO. : 5,437,142

DATED : August 1, 1995

INVENTOR(S) : H. AKIYAMA et al.

It is certified that error appears in the above-indentified patent and that said Letters Patent is hereby corrected as shown below:

At column 7, line 66, after "away" insert ---from---.

At column 8, line 29, change "If." to ---1f.---.

At column 16. line 37, change "ends" to ---ends.---.

At column 25, line 50 (claim 15, line 4), change "form" to ---form,---.

Signed and Sealed this

Twelfth Day of November, 1996

*Attest:*

Bruce Lehman

BRUCE LEHMAN

*Attesting Officer*

*Commissioner of Patents and Trademarks*